US009563166B2

(12) United States Patent
Morishita

(10) Patent No.: US 9,563,166 B2
(45) Date of Patent: Feb. 7, 2017

(54) DRUM SUPPORTING STRUCTURE FOR SUPPORTING PHOTOSENSITIVE DRUM, IMAGE FORMING APPARATUS, AND BEARING FOR SUPPORTING PHOTOSENSITIVE DRUM

(71) Applicant: KYOCERA Document Solutions Inc., Osaka-shi, Osaka (JP)

(72) Inventor: Hiroki Morishita, Osaka (JP)

(73) Assignee: KYOCERA Document Solutions Inc., Osaka-shi (JP)

( * ) Notice: Subject to any disclaimer, the term of this patent is extended or adjusted under 35 U.S.C. 154(b) by 0 days.

(21) Appl. No.: 14/574,276

(22) Filed: Dec. 17, 2014

(65) Prior Publication Data

US 2015/0185679 A1 Jul. 2, 2015

(30) Foreign Application Priority Data

Dec. 26, 2013 (JP) ..... 2013-268884

(51) Int. Cl.
*G03G 15/00* (2006.01)
*G03G 21/16* (2006.01)

(52) U.S. Cl.
CPC ..... *G03G 15/757* (2013.01); *G03G 21/1647* (2013.01)

(58) Field of Classification Search
CPC ..... G03G 21/1647; G03G 21/1853; G03G 21/1671; G03G 21/1803; G03G 21/181; G03G 15/757; G03G 2215/2035
USPC ..... 399/117, 113
See application file for complete search history.

(56) References Cited

U.S. PATENT DOCUMENTS

| | | | | |
|---|---|---|---|---|
| 6,556,796 | B1 * | 4/2003 | Chavez et al. | 399/110 |
| 2005/0238387 | A1 | 10/2005 | Ueno et al. | |
| 2005/0238395 | A1 | 10/2005 | Ueno et al. | |
| 2007/0110474 | A1 | 5/2007 | Ueno et al. | |
| 2011/0268471 | A1 * | 11/2011 | Miyazaki et al. | 399/111 |
| 2012/0321348 | A1 * | 12/2012 | Toriu | G03G 15/751 399/159 |

FOREIGN PATENT DOCUMENTS

| | | | |
|---|---|---|---|
| JP | 10104995 | A | 4/1998 |
| JP | 2005070307 | A | 3/2005 |
| JP | 2005338751 | A | 12/2005 |
| JP | 2007219266 | A | 8/2007 |

* cited by examiner

*Primary Examiner* — Walter L Lindsay, Jr.
*Assistant Examiner* — Jessica L Eley
(74) *Attorney, Agent, or Firm* — Alleman Hall McCoy Russell & Tuttle LLP

(57) ABSTRACT

A drum supporting structure according to one aspect of the present disclosure includes a bearing. The bearing is configured to support a flange of a photosensitive drum connected to a shaft joint member that is connected to a drive shaft through which drive power is transmitted, such that the flange of the photosensitive drum is rotatable. The bearing includes an inner circumferential surface that is fitted on an outer surface of the flange, and two planes that are formed on the inner circumferential surface and that contact with the flange. The bearing supports the flange by the flange contacting with the two planes at two points due to a load applied from a peripheral device to the photosensitive drum, such that the flange is rotatable.

8 Claims, 17 Drawing Sheets

DRUM SUPPORTING STRUCTURE FOR SUPPORTING PHOTOSENSITIVE DRUM, IMAGE FORMING APPARATUS, AND BEARING FOR SUPPORTING PHOTOSENSITIVE DRUM

INCORPORATION BY REFERENCE

This application is based upon and claims the benefit of priority from the corresponding Japanese Patent Application No. 2013-268884 filed on Dec. 26, 2013, the entire contents of which are incorporated herein by reference.

BACKGROUND

The present disclosure relates to a drum supporting structure for supporting photosensitive drums, image forming apparatuses having the drum supporting structure, and bearings for supporting the photosensitive drums.

To date, in image forming apparatuses such as printers and copy machines, a drum unit including a photosensitive drum has been detachably mounted. Further, in some image forming apparatuses, the photosensitive drums are inserted from above image forming apparatus bodies. In this type of image forming apparatus, the drum unit may be fixed (positioned) by using the following structure.

The apparatus body includes a pair of side plates by which the drum unit is supported. Each of the paired side plates has a cut portion extending in the up-down direction. Further, the apparatus body includes a driving motor, and an apparatus-body-side gear which is driven to rotate by the driving motor. On the other hand, a large-diameter gear that reduces a rotation rate of the driving motor to a predetermined rotation rate for the photosensitive drum is mounted to a rotation shaft of the photosensitive drum. This is for assuredly matching the rotation rate of the photosensitive drum with the rotation rate of the large-diameter gear, to prevent an error therebetween. The rotation shaft of the photosensitive drum is fitted into the cut portions formed on the pair of side plates, thereby mounting the drum unit to the apparatus body. At this time, the apparatus-body-side side gear and the large-diameter gear mesh with each other, and a rotation rate of the driving motor is reduced at a predetermined reduction ratio by the large-diameter gear, thereby transmitting the rotational power of the driving motor to the photosensitive drum.

SUMMARY

A drum supporting structure according to one aspect of the present disclosure includes a bearing. The bearing is configured to support a flange of a photosensitive drum connected to a shaft joint member that is connected to a drive shaft through which drive power is transmitted, such that the flange of the photosensitive drum is rotatable. The bearing includes an inner circumferential surface that is fitted on an outer surface of the flange, and two planes that are formed on the inner circumferential surface and that contact with the flange. The bearing supports the flange by the flange contacting with the two planes at two points due to a load applied from a peripheral device to the photosensitive drum, such that the flange is rotatable.

An image forming apparatus according to another aspect of the present disclosure includes the drum supporting structure.

A bearing according to still another aspect of the present disclosure includes two planes that contact, at two points, with a flange of a photosensitive drum connected to a shaft joint member that is connected to a drive shaft through which drive power is transmitted, due to a load applied from a peripheral device to the photosensitive drum. The bearing supports the photosensitive drum due to contact with the two planes such that the photosensitive drum is rotatable.

This Summary is provided to introduce a selection of concepts in a simplified form that are further described below in the Detailed Description with reference where appropriate to the accompanying drawings. This Summary is not intended to identify key features or essential features of the claimed subject matter, nor is it intended to be used to limit the scope of the claimed subject matter. Furthermore, the claimed subject matter is not limited to implementations that solve any or all disadvantages noted in any part of this disclosure.

DETAILED DESCRIPTION

Hereinafter, an embodiment of the present disclosure will be described with reference to the drawings. The embodiment described below represents an exemplary implementation of the present disclosure, and the technical scope of the present disclosure is not limited by the embodiment described below.

Figure 1:
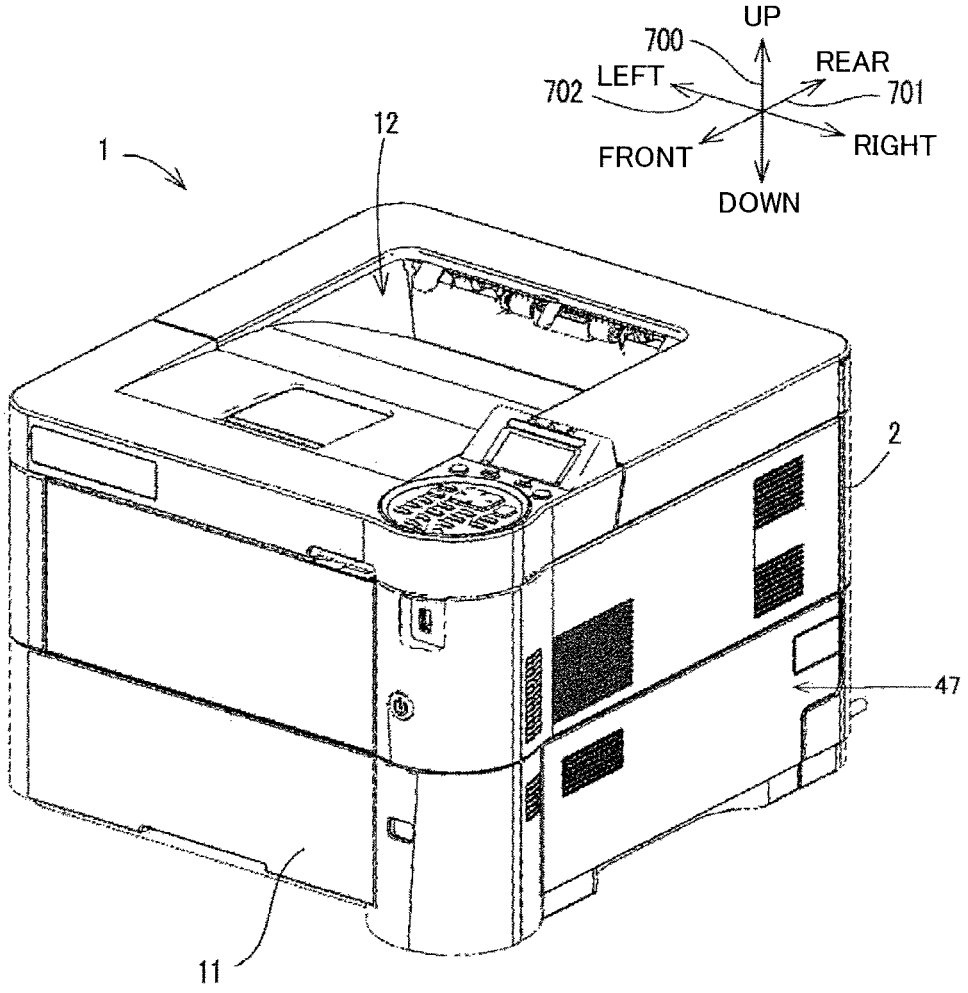
FIG. 1 illustrates a structure of an image forming apparatus according to one embodiment of the present disclosure.

FIG. 1 is a schematic diagram illustrating a structure of an image forming apparatus 1 according to an embodiment of the present disclosure. The image forming apparatus 1 is an example of an image forming apparatus of the present disclosure. In the following description, an up-down direction 700, a front-rear direction 701, and a left-right direction 702 as defined in FIG. 1 in a state where the image forming apparatus 1 is mounted so as to be usable, may be used.

As shown in FIG. 1, the image forming apparatus 1 is a multifunction peripheral having various functions such as a scanning function, a copying function, a printing function, and a facsimile function. The image forming apparatus 1 is not limited to a multifunction peripheral. Examples of the image forming apparatus of the present disclosure include printers, facsimile apparatuses, copy machines, and the like.

The image forming apparatus 1 prints an image on a printing sheet based on image data inputted from the outside via a not-illustrated network communication portion. As shown in FIG. 1, the image forming apparatus 1 has a housing 2 including a cover of an outer frame, and an inner frame.

Figure 2:
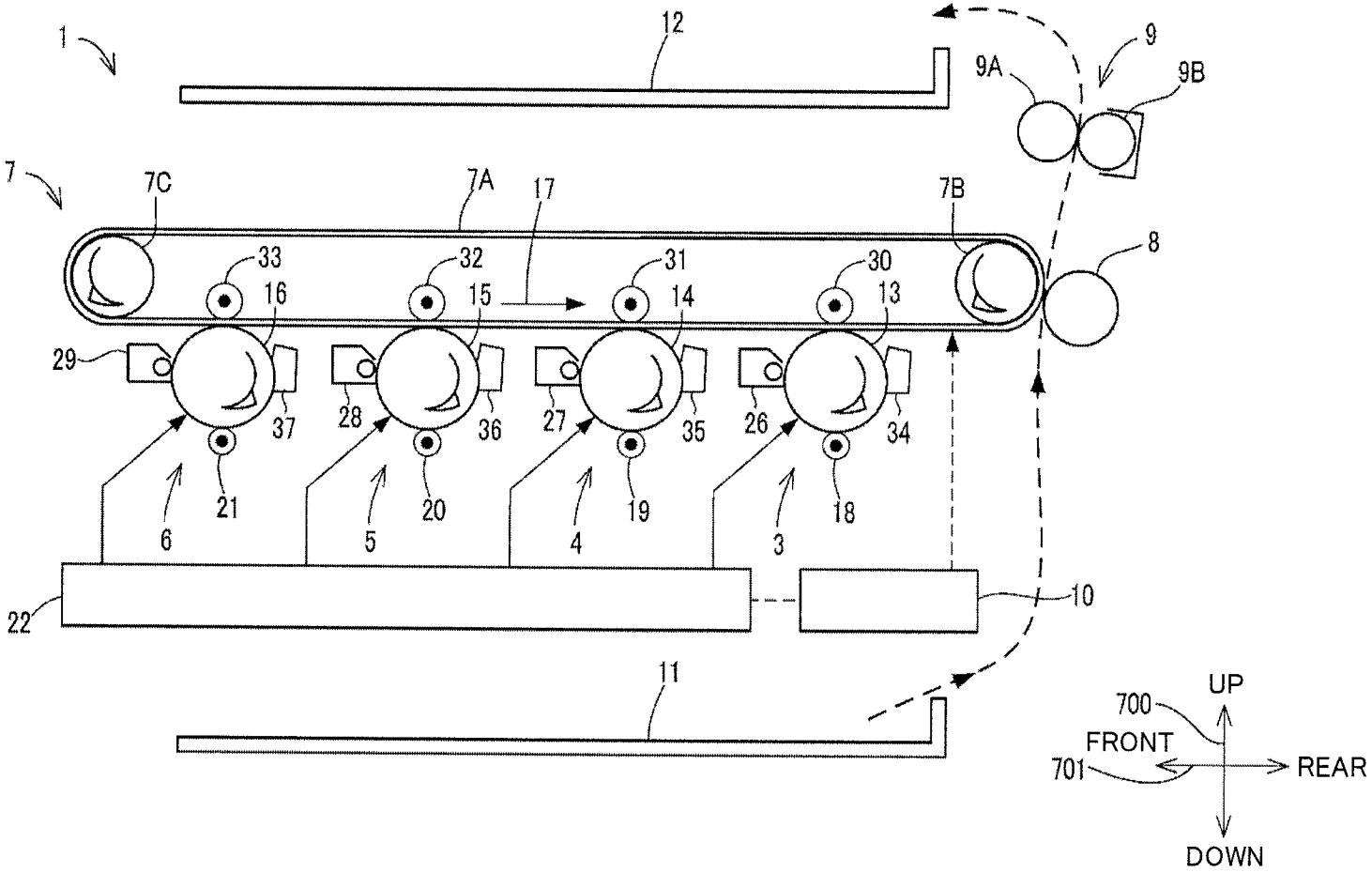
FIG. 2 illustrates an internal structure of an image reading portion.

As shown in FIG. 2, the image forming apparatus 1 is a so-called tandem-type color image forming apparatus, and includes a plurality of image forming portions 3 to 6, an intermediate transfer unit 7, a secondary transfer portion 8, a fixing portion 9, a control portion 10, a sheet feed portion 11, and a sheet discharge portion 12.

The image forming portions 3 to 6 are aligned in parallel with each other in the front-rear direction 701. The image forming portions 3 to 6 form toner images having different colors, respectively. The image forming portion 3 is an image forming portion for black color, the image forming portion 4 is an image forming portion for yellow color, the image forming portion 5 is an image forming portion for cyan color, and the image forming portion 6 is an image forming portion for magenta color.

The image forming portions 3 to 6 include: photosensitive drums 13 to 16, respectively, which carry toner images; charging rollers 18 to 21, respectively, which allow surfaces of the photosensitive drums 13 to 16 to be charged; and an exposure portion 22 that exposes, to light, the surfaces of the photosensitive drums 13 to 16 having been charged, to write electrostatic latent images by scanning of the light. Further, the image forming portions 3 to 6 include: developing portions 26 to 29 that develop the electrostatic latent images on the photosensitive drums 13 to 16, respectively, by using toner; primary transfer rollers 30 to 33 that transfer toner images on the photosensitive drums 13 to 16, respectively, which are rotating, to an intermediate transfer belt 7A that is traveling; and cleaning portions 34 to 37 that remove residual toner on the photosensitive drums 13 to 16, respectively. The charging rollers 18 to 21 correspond to a charging device, the developing portions 26 to 29 correspond to a developing device, and the primary transfer rollers 30 to 33 correspond to a transfer device.

The intermediate transfer unit 7 has the intermediate transfer belt 7A, a drive roller 7B, and a follower roller 7C. The intermediate transfer belt 7A is, for example, an endless annular belt formed from a rubber or a urethane. The intermediate transfer belt 7A is supported by the drive roller 7B and the follower roller 7C so as to be rotationally driven. The drive roller 7B is disposed near the fixing portion 9 (on the right side in FIG. 2), and the follower roller 7C is disposed so as to be distant from the fixing portion 9 (on the left side in FIG. 2). The surface of the drive roller 7B is formed from, for example, a rubber or a urethane so as to enhance friction between the intermediate transfer belt 7A and the drive roller 7B.

In the example shown in FIG. 2, the image forming portion 3 for black color, the image forming portion 4 for yellow color, the image forming portion 5 for cyan color, and the image forming portion 6 for magenta color are aligned in line in order, respectively, from the rear side in the front-rear direction 701. Since the intermediate transfer belt 7A is supported by the drive roller 7B and the follower roller 7C, the intermediate transfer belt 7A can be moved (can travel) such that the surface thereof contacts with the surfaces of the photosensitive drums 13 to 16. On the surface of the intermediate transfer belt 7A, the toner images of the photosensitive drums 13 to 16 are overlaid and transferred in order, respectively, while the intermediate transfer belt 7A passes between the photosensitive drums 13 to 16 and the primary transfer rollers 30 to 33, respectively.

The secondary transfer portion 8 transfers the toner image having been transferred to the intermediate transfer belt 7A, to a printing sheet conveyed from the sheet feed portion 11. The printing sheet to which the toner image has been transferred is conveyed to the fixing portion 9 by a not-illustrated conveying portion. The fixing portion 9 includes a heating roller 9A which may be heated to a temperature of about 200° C. or higher, and a pressure roller 9B disposed so as to oppose the heating roller 9A. The printing sheet having been conveyed to the fixing portion 9 is nipped and conveyed by the heating roller 9A and the pressure roller 9B, to fuse and fix the toner image onto the printing sheet. Thereafter, the printing sheet is discharged into the sheet discharge portion 12.

Thus, the image forming apparatus 1 operates the plurality of image forming portions 3 to 6 so as to overlay and transfer the toner images of the respective colors onto the intermediate transfer belt 7A that is traveling, thereby forming a color toner image on the surface of the intermediate transfer belt 7A. Further, the image forming apparatus 1 transfers the color toner image from the intermediate transfer belt 7A to a printing sheet by means of the secondary transfer portion 8, thereby forming a color image on the printing sheet. A structure in which the intermediate transfer belt 7A is used as a conveyance belt, and toner images are directly overlaid and transferred onto a printing sheet conveyed on the conveyance belt, may be considered as another example. Further, in another example, a roller-like intermediate transfer member may be used instead of the intermediate transfer belt 7A.

The cleaning portions 34 to 37 remove toner (residual toner) that is left on the surfaces of the photosensitive drums 13 to 16 after transfer of the toner images onto a sheet. The cleaning portions 34 to 37 will be described below.

The sheet feed portion 11 has a sheet feed cassette in which sheets on which images are to be formed by the image forming portions 3 to 6 or the like are stored. In the sheet feed cassette, a plurality of sheets can be stacked and stored.

Figure 3:
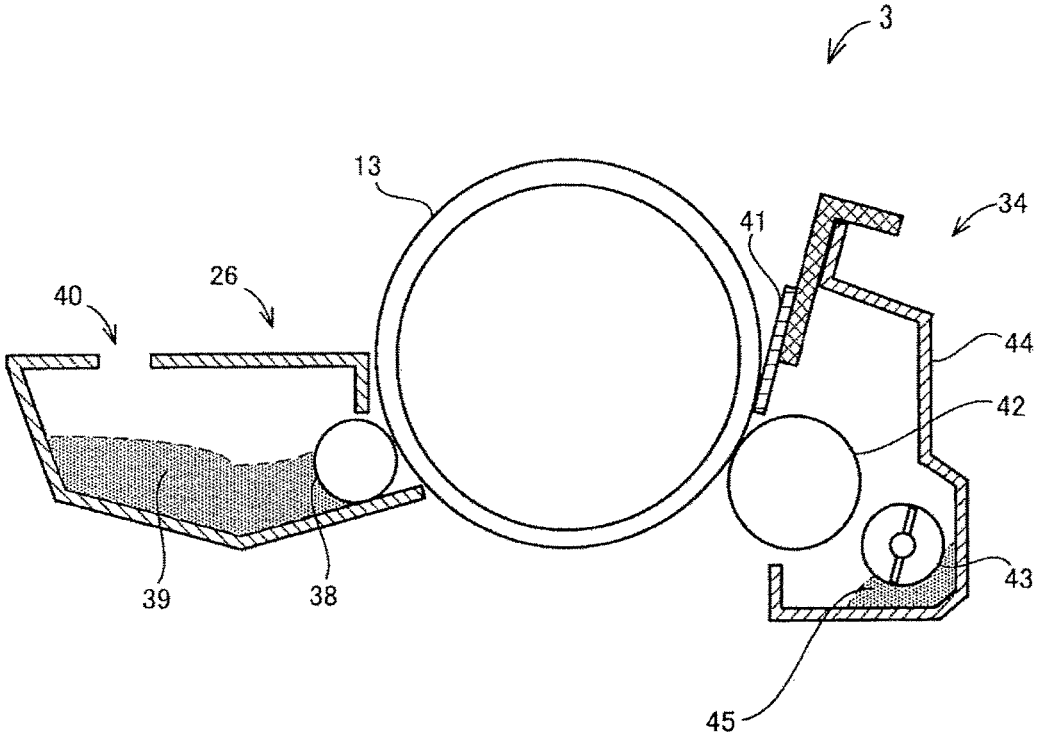
FIG. 3 illustrates a structure of a region around a photosensitive drum.

FIG. 3 is a cross-sectional view schematically illustrating the photosensitive drums 13 to 16, the developing portions 26 to 29, and the cleaning portions 34 to 37 in the image forming portions 3 to 6, respectively. The image forming portions 3 to 6 have the same structure. Therefore, the structure of the image forming portion 3 will be described.

As shown in FIG. 3, the image forming portion 3 includes the developing portion 26, the photosensitive drum 13, and the cleaning portion 34.

The developing portion 26 has a developing magnet roller 38 near the photosensitive drum 13. To the magnet roller 38, a bias having the same polarity as a charge polarity of the photosensitive drum 13 is applied. Toner 39, which is developer, is charged, and flies to the electrostatic latent image on the surface of the photosensitive drum 13, by means of the magnet roller 38, to develop the electrostatic latent image. The toner 39 is supplied from a toner container (not shown) through a toner supply inlet 40.

The cleaning portion 34 includes a cleaning blade 41, a cleaning roller 42, a discharge screw 43, and a toner box 44 that form a cleaning member. The cleaning roller 42 and the cleaning blade 41 each have almost the same length as the photosensitive drum 13 in the axial direction, and are disposed so as to contact with the photosensitive drum 13.

After transfer of a toner image onto a printing sheet, the cleaning roller 42 and the cleaning blade 41 of the cleaning portion 34 remove toner left on the surface of the photosensitive drum 13 to perform cleaning. The toner removed from the surface of the photosensitive drum 13 enters the toner box 44 due to action of gravity or according to rotation of the cleaning roller 42. Waste toner 45 having entered the toner box 44 is conveyed from the back side of the sheet for FIG. 2 to the front side therefor (from the left side to the right side in the left-right direction 702 of the image forming apparatus 1) by the discharge screw 43.

Figure 4:
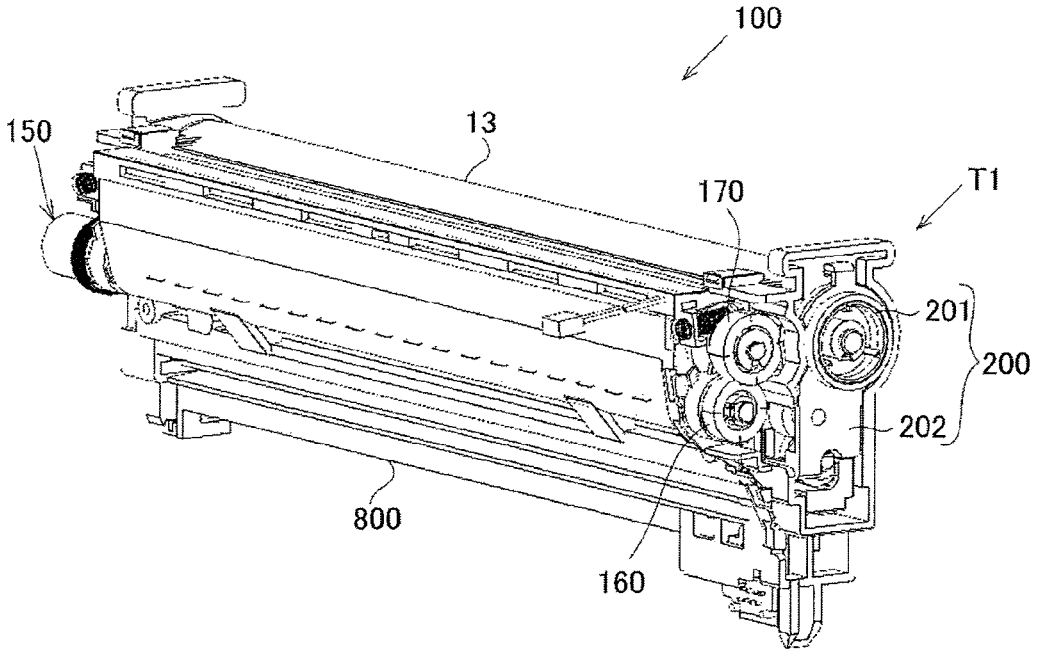
FIG. 4 illustrates a structure of a cleaning unit.

As shown in FIG. 4, the photosensitive drums 13 to 16 and the cleaning portions 34 to 37 of the image forming portions 3 to 6, are mounted to housings 800 so as to be formed as units, respectively. Each unit is referred to as a cleaning unit 100. The cleaning unit 100 corresponds to a cleaning device, and is a consumable part that should be periodically exchanged. The cleaning units 100 of the image forming portions 3 to 6 have the same structure.

As shown in FIG. 1, the right side surface of the housing 2 of the image forming apparatus 1 is formed as an external cover 47 that is removable. When the external cover 47 is removed, a waste toner conveying unit 46 and a waste toner bottle 48 are exposed as shown in FIG. 5.

Figure 5:
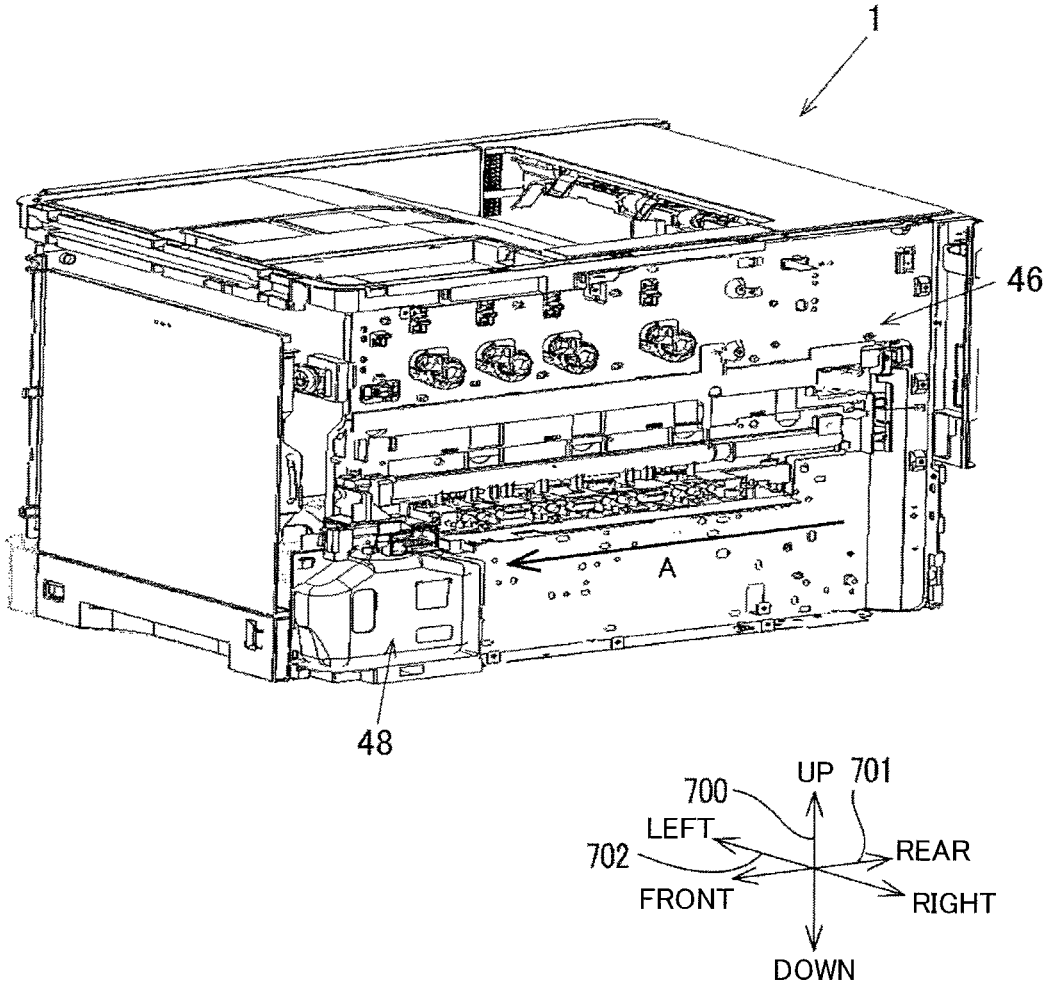
FIG. 5 illustrates a state where an external cover is removed from the image forming apparatus.
Figure 6:
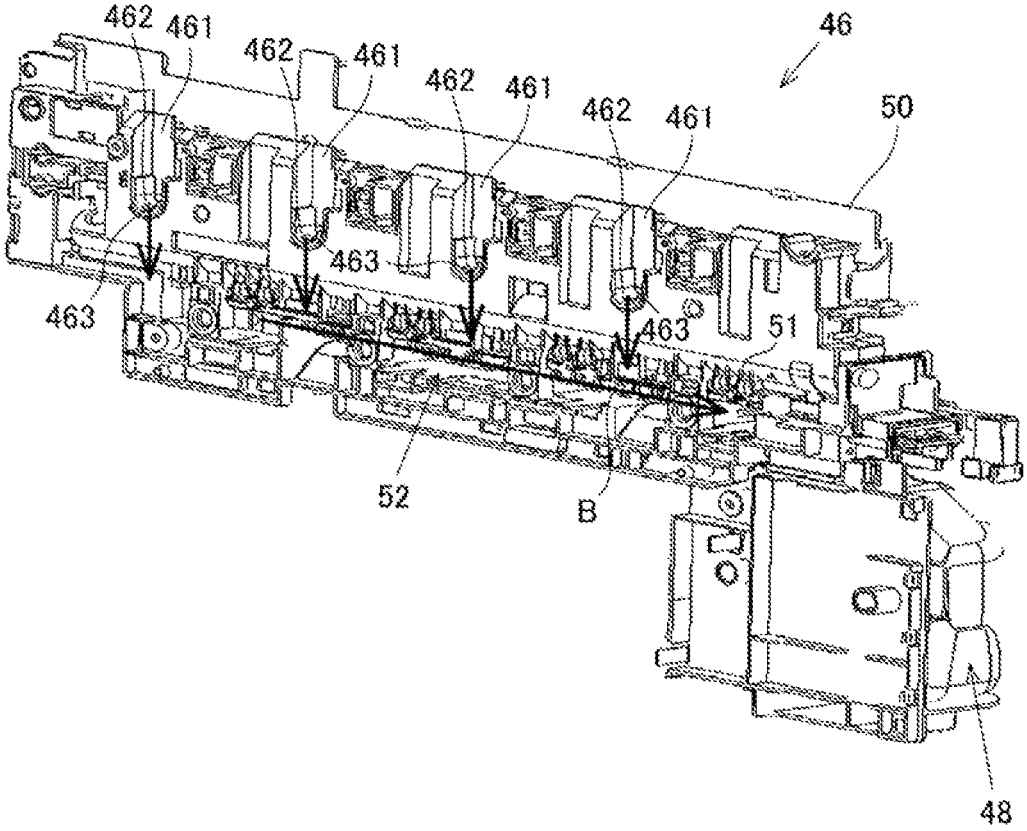
FIG. 6 illustrates a structure of a waste toner conveying unit.

As shown in FIG. 5, the waste toner conveying unit 46 is mounted on the right side surface of the image forming apparatus 1 so as to be detachable from the apparatus body, and extends in the front-rear direction 701 so as to be connectable to the four cleaning units 100 aligned in parallel with each other. As shown in FIG. 6, the waste toner conveying unit 46 includes a casing member 50 and a conveying screw 51. The casing member 50 forms a waste toner conveying chamber 52 that extends in the front-rear direction, in the right side portion of the image forming apparatus 1. The conveying screw 51 is accommodated in the waste toner conveying chamber 52.

In the casing member 50, four unit connection grooves 461 are formed at regular intervals, and toner discharge outlets (not shown) formed in the cleaning units 100 are connected to the four unit connection grooves 461, respectively. Each unit connection groove 461 is shaped like a cut portion formed by cutting from the upper side toward the lower side, and an end portion 150 (see FIG. 4), of the cleaning unit 100, having the outlet, is inserted into the unit connection groove 461 downward from the upper end. A contact portion 462 having a shape corresponding to that of the end portion 150 of the cleaning unit 100 is formed in the lower end portion of each unit connection groove 461. A waste toner inlet 463 is formed in the lower circumferential surface of the contact portion 462.

When each cleaning unit 100 is connected to the waste toner conveying unit 46, the outlet (not shown) of each cleaning unit 100 communicates with the waste toner inlet 463 of the contact portion 462. The waste toner conveying chamber 52 is disposed below each waste toner inlet 463, and is connected to the waste toner inlet 463 via a not-illustrated fall path. Therefore, the waste toner conveyed by each cleaning unit 100 falls through the waste toner inlet 463 to be joined in the waste toner conveying chamber 52.

Thus, the waste toner conveyed from the image forming portions 3 to 6 is conveyed to the waste toner conveying chamber 52. The conveying screw 51 operates to horizontally convey the waste toner having been conveyed, from the rear side of the image forming apparatus 1, to the waste toner bottle 48 disposed in the front right corner portion, in the direction indicated by an arrow A in FIG. 5 (in the direction indicated by an arrow B in FIG. 6). The waste toner bottle 48 is an example of a waste toner storage portion, and waste toner collected after use of toner in the image forming portions 3 to 6 is stored in the waste toner bottle 48.

As shown in FIG. 4, the cleaning unit 100 has a gear 160 connected to the cleaning roller 42 and a gear 170 connected to the discharge screw 43, and the gear 160 and the gear 170 are disposed at the end portion on the side opposite to the side on which the end portion 150, of the cleaning unit 100, having the outlet is positioned. The gears 160 and 170 mesh with each other. When one of the gears 160 and 170 is driven by rotational power of a not-illustrated driving motor, the other of the gears 160 and 170 is driven to rotate. Therefore, the cleaning roller 42 and the discharge screw 43 rotate in conjunction with each other.

The photosensitive drum 13 is driven to rotate by a not-illustrated driving motor at an end portion (hereinafter, referred to as a driving-side end portion) T1 on the side opposite to the side on which the end portion 150, of the cleaning unit 100, having the outlet is positioned. Further, the driving-side end portion T1 is supported by a drum supporting structure 600 (see FIG. 11), which will be described below.

Figure 7A:
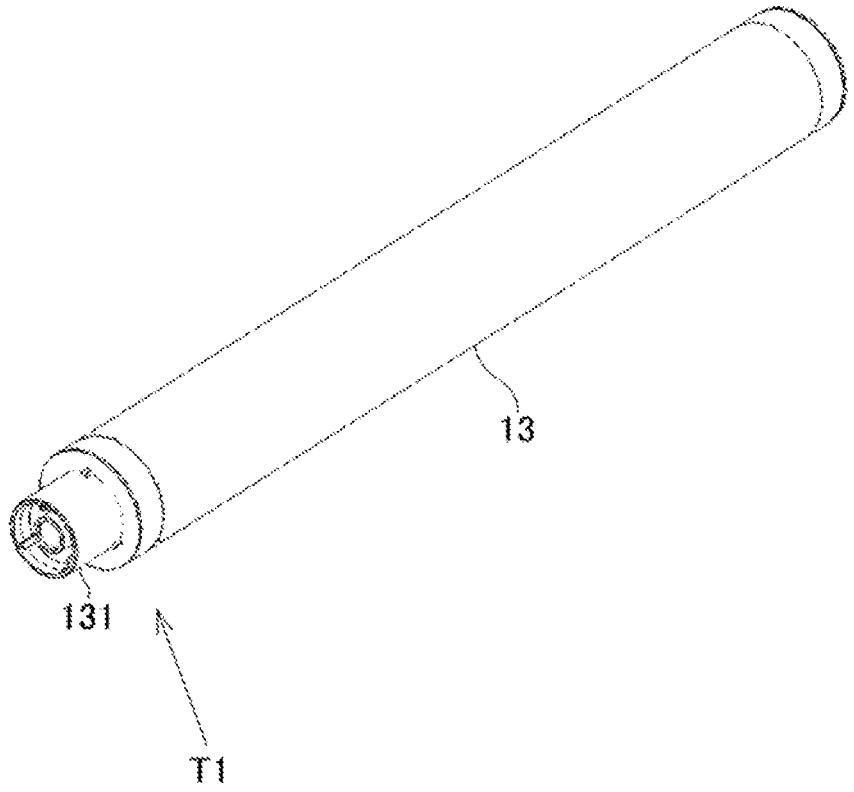
FIG. 7A and FIG. 7B illustrate a structure of the photosensitive drum.
Figure 7B:
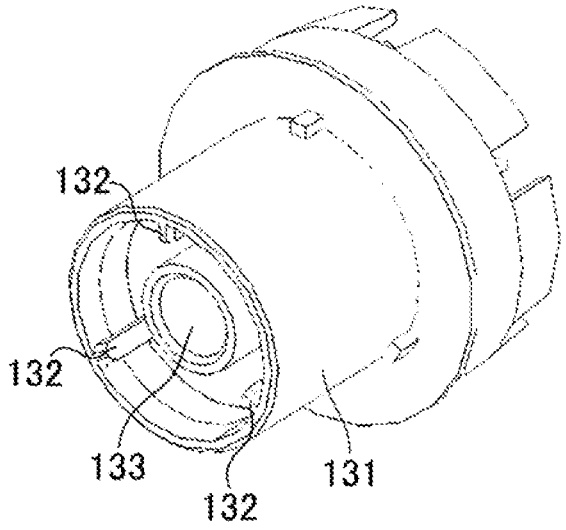

As shown in FIG. 7A and FIG. 7B, a cylindrical flange 131 is disposed at the driving-side end portion T1 of the photosensitive drum 13. Projections 132 are formed on an inner circumferential surface of the flange 131 at regular intervals in the circumferential direction. A rotation shaft 133 of the photosensitive drum 13 is disposed at the center portion of the cross-section of the flange 131. The rotation shaft 133 is fitted into a shaft joint member 404 (see FIG. 11) described below.

Figure 8:
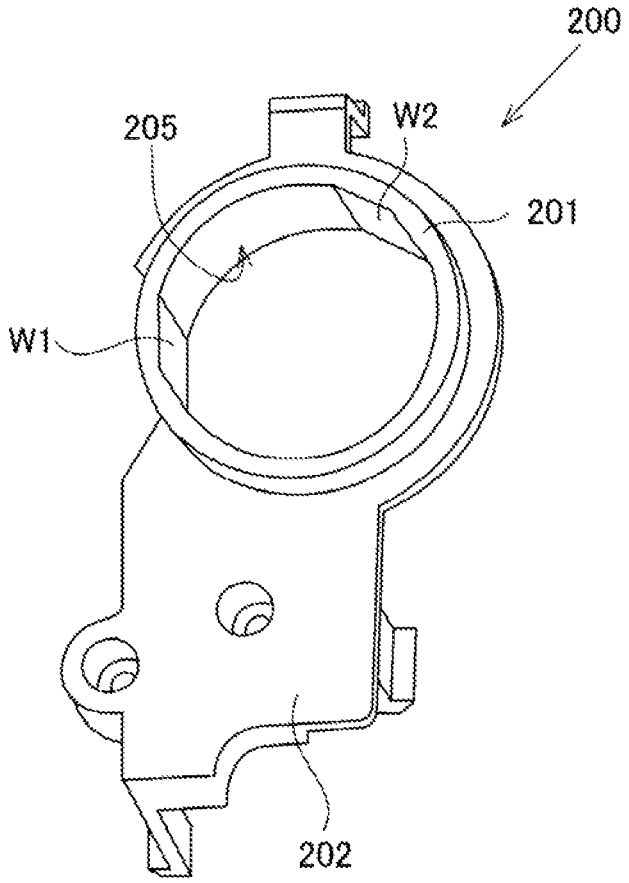
FIG. 8 illustrates a structure of a bearing.
Figure 17A:
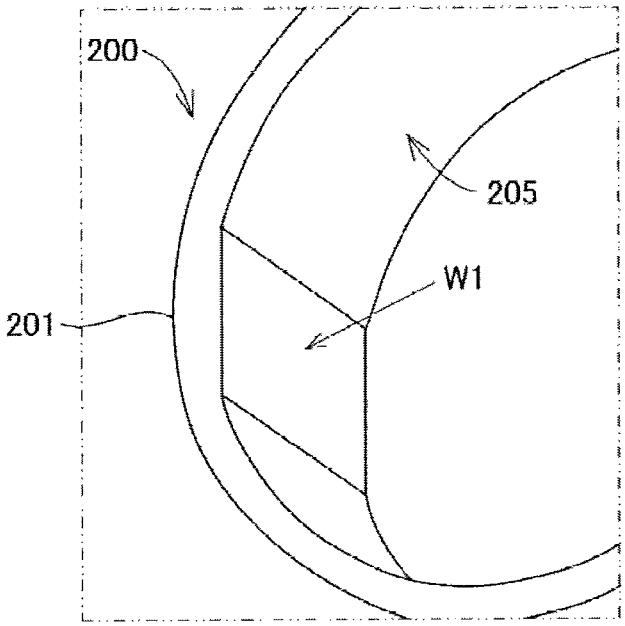
FIG. 17A and FIG. 17B are each an enlarged view of a plane portion formed on an inner circumferential surface of the fitting portion.
Figure 17B:
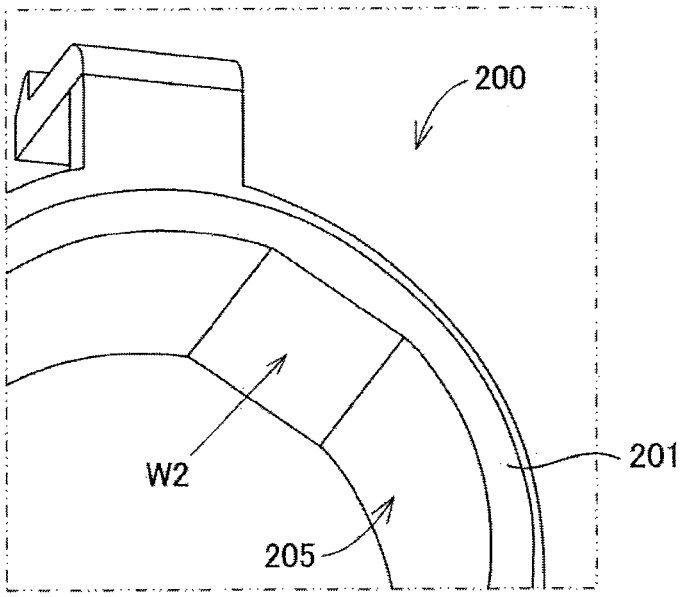

A bearing 200 shown in FIG. 8 is fitted onto the outer surface of the flange 131 of the photosensitive drum 13. The bearing 200 is disposed in the cleaning unit 100, and supports the photosensitive drum 13 such that the photosensitive drum 13 is rotatable. As shown in FIG. 8, the bearing 200 includes a fitting portion 201 and a mounting portion 202. The fitting portion 201 has a cylindrical shape, and is fitted onto the outer surface of the flange 131 of the photosensitive drum 13. An inner circumferential surface 205 of the fitting portion 201 is partially planar. The planer portion is referred to as plane portions W1, W2 (see FIG. 17A and FIG. 17B), and this will be described below. The mounting portion 202 extends from the fitting portion 201 in one direction, and the mounting portion 202 is used for mounting the bearing 200 to the housing 800 of the cleaning unit 100. The bearing 200 is mounted to the housing 800, whereby the bearing 200 is disposed in the cleaning unit 100.

Figure 9:
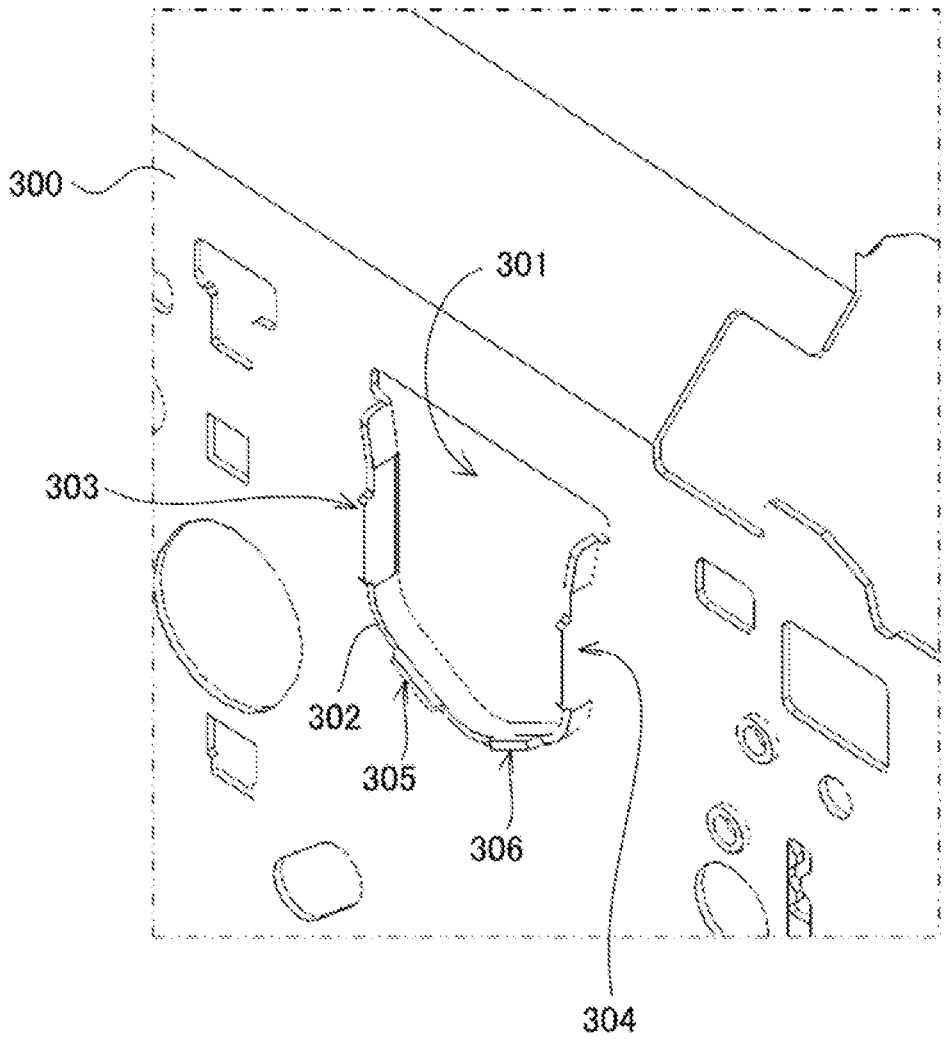
FIG. 9 is a perspective view of structures of a through hole and a flange portion formed on a side plate.

The bearing 200 into which the flange 131 of the photosensitive drum 13 is fitted is supported by a side plate 300 shown in FIG. 9. The side plate 300 has almost a home-plate-shaped through hole 301. Further, the side plate 300 has a flange portion 302 that is formed so as to stand from the side plate 300 along an edge portion of the through hole 301. The flange portion 302 includes a first flange portion 303, a second flange portion 304, a third flange portion 305, and a fourth flange portion 306. The first flange portion 303 and the second flange portion 304 stand from the side plate 300 along the left edge portion and the right edge portion, respectively, of the through hole 301. The third flange portion 305 and the fourth flange portion 306 stand from the side plate 300 along the two linear edge portions which form a V-shape for the through hole 301.

Figure 10:
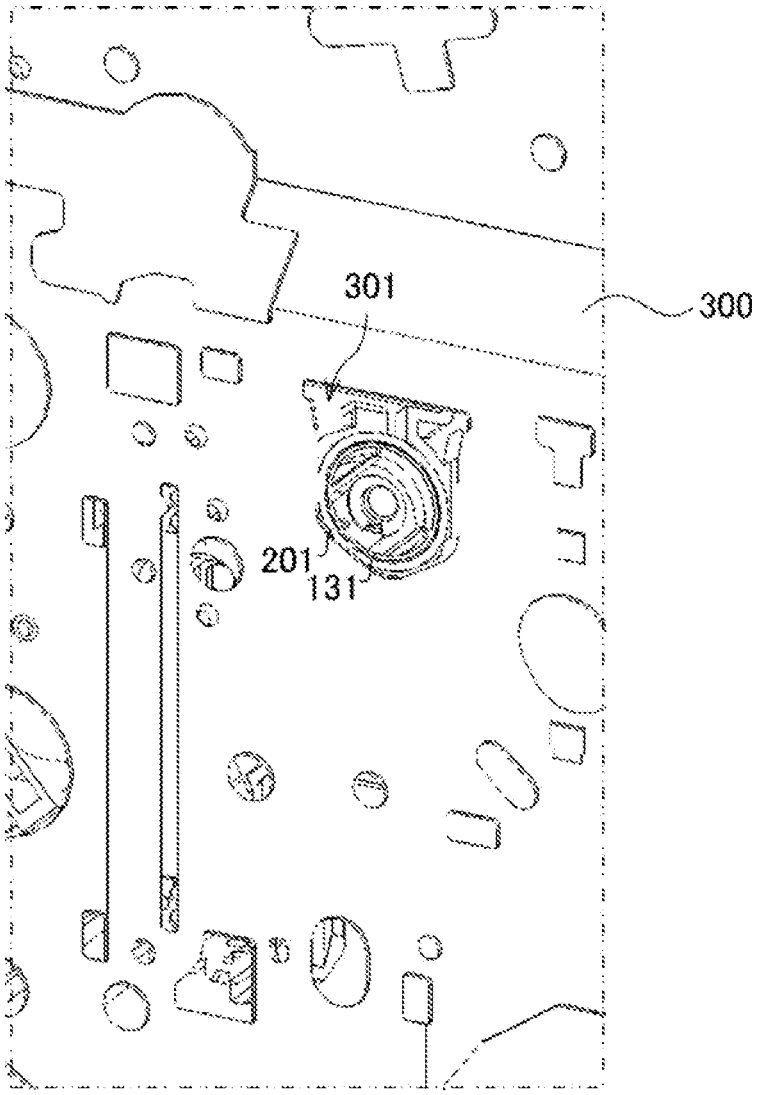
FIG. 10 illustrates a state where the bearing is supported by the flange portion formed on a body frame.
Figure 11:
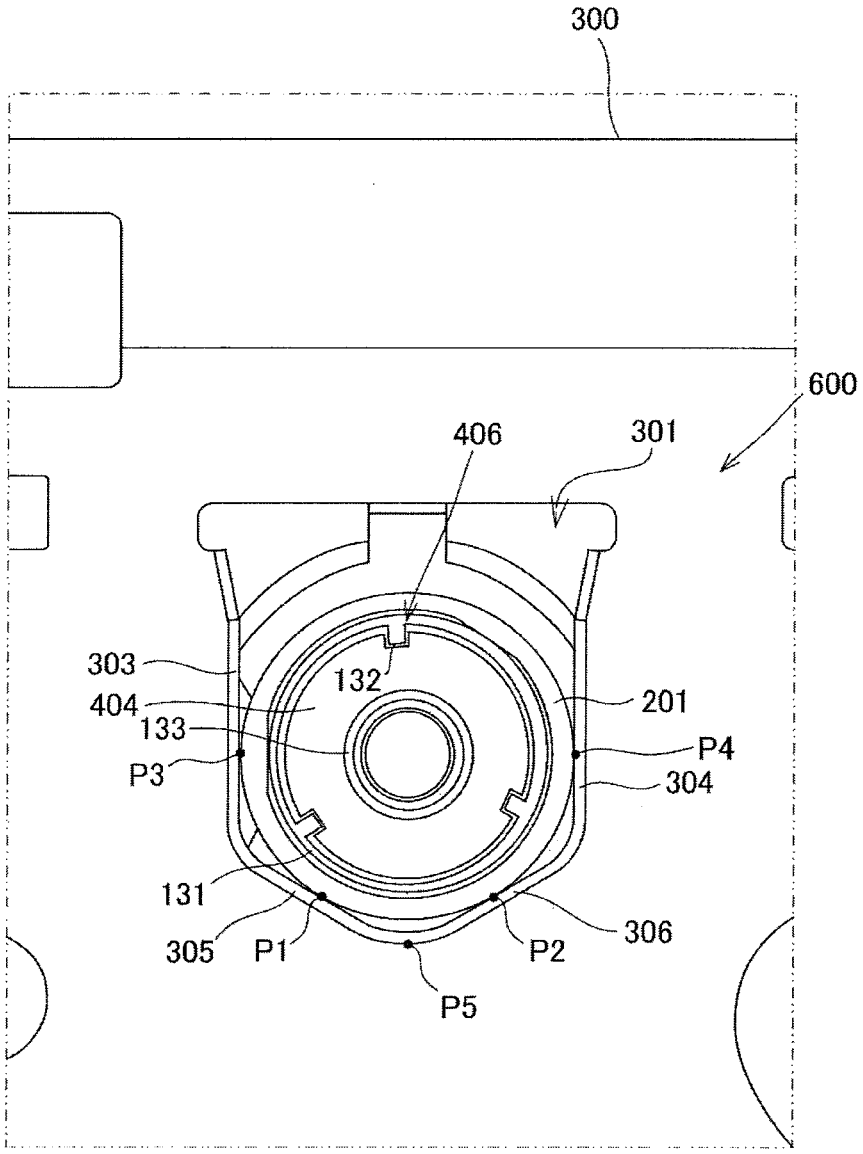
FIG. 11 illustrates a state where the photosensitive drum is fitted into the through hole formed on the side plate.

When the cleaning unit 100 is mounted to the apparatus body, the fitting portion 201 of the bearing 200 is fitted into the through hole 301 as shown in FIG. 10. Further, the fitting portion 201 of the bearing 200 is supported by the side plate 300 through the flange portion 302. As shown in FIG. 11, the fitting portion 201 of the bearing 200 contacts with the third flange portion 305 and the fourth flange portion 306 of the flange portion 302 at two points, that is, a point P1 and a point P2, and is supported at the points P1 and P2 by the third flange portion 305 and the fourth flange portion 306. The points P1 and P2 are two points that are line-symmetric with respect to the vertical line passing through a vertex P5 at which the third flange portion 305 and the fourth flange portion 306 intersect each other, and the points P1 and P2 are on the same level. Thus, the bearing 200 is stably supported, and positioned with respect to the through hole 301. The flange portion 302 is an example of a bearing support portion. In the present embodiment, the bearing 200 also contacts with the first flange portion 303 and the second flange portion 304 of the flange portion 302 at two points, that is, a point P3 and a point P4, and is supported at the points P3 and P4 by the first flange portion 303 and the second flange portion 304. However, the bearing 200 is supported assuredly with a certain degree of stability even if the bearing 200 does not contact with the first flange portion 303 and the second flange portion 304.

Figure 12:
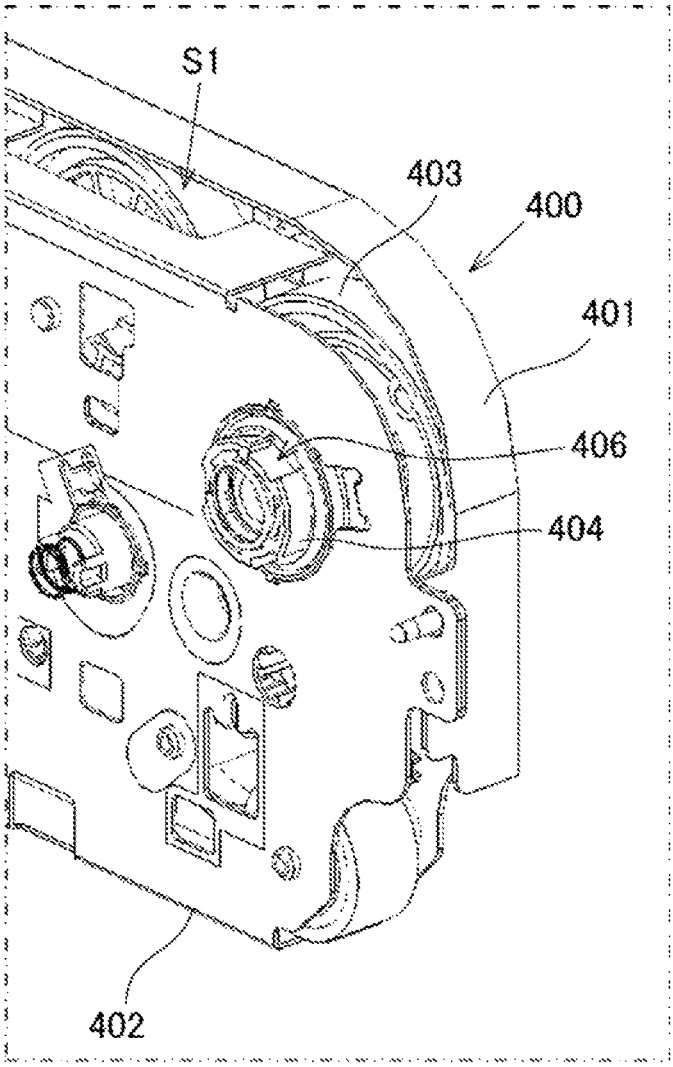
FIG. 12 illustrates a structure of a driving-side unit.

FIG. 12 shows a driving-side unit 400 that generates power for rotating the photosensitive drum 13. The driving-side unit 400 is mounted to the apparatus body, and includes a first support plate 401, a second support plate 402, a large-diameter gear 403, and the shaft joint member 404, as shown in FIG. 12. The large-diameter gear 403 is a gear that reduces a rotation rate of the driving motor (not shown) to a predetermined rotation rate for the photosensitive drum 13, and the large-diameter gear 403 is driven to rotate by drive power of the driving motor. The large-diameter gear 403 and the driving motor are disposed in a space S1 between the first support plate 401 and the second support plate 402 that stand so as to be spaced from each other by a predetermined distance.

Figure 13:
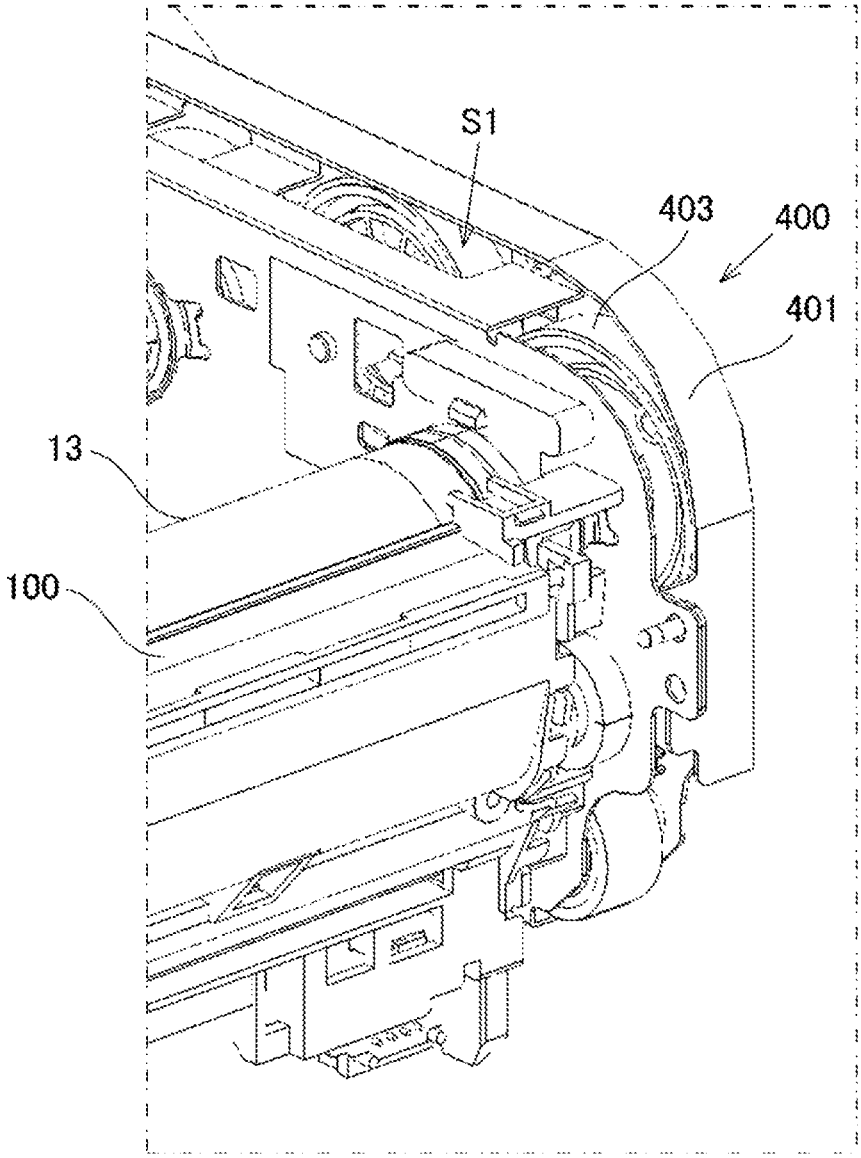
FIG. 13 illustrates a state where the cleaning unit is mounted to the driving-side unit.

The second support plate 402 has a through hole (not shown). A rotation shaft of the large-diameter gear 403 passes through the through hole to penetrate the second support plate 402, and projects on the side opposite to the large-diameter gear 403 side. The shaft joint member 404 is fitted and fixed onto the outer surface of the projecting portion. The shaft joint member 404 has almost a cylindrical shape, and is connected to the photosensitive drum 13. Specifically, recesses 406 are formed in the outer circumferential portion of the shaft joint member 404 at regular intervals in the circumferential direction. On the other hand, the projections 132 (see FIG. 7A and FIG. 7B) are formed on the inner circumferential surface of the flange 131 of the photosensitive drum 13 at regular intervals in the circumferential direction. When the shaft joint member 404 and the photosensitive drum 13 are connected to each other, the recesses 406 of the shaft joint member 404 and the projections 132 of the flange 131 of the photosensitive drum 13 engage with each other. FIG. 13 shows a state where the cleaning unit 100 including the photosensitive drum 13, and the driving-side unit 400 are connected to each other. In FIG. 13, the side plate 300 is not shown.

In this structure, in order to mount the cleaning unit 100 to the apparatus body, the cleaning unit 100 is inserted from above the apparatus body. Then, the shaft joint member 404 and the flange 131 of the photosensitive drum 13 are connected to each other, and the end portion 150, of the cleaning unit 100, having the outlet is inserted into the unit connection groove 461 downward from the upper end, thereby mounting the cleaning unit 100 to the apparatus body.

When the cleaning unit 100 is mounted to the apparatus body, rotational power of the large-diameter gear 403 driven by the driving motor is transmitted to the shaft joint member 404. Further, the rotational power transmitted to the shaft joint member 404 is transmitted to the photosensitive drum 13 through the flange 131. The photosensitive drum 13 rotates in a state where the flange 131 is fitted into the fitting portion 201 of the bearing 200 supported by the side plate 300.

In such an image forming apparatus that a unit including a photosensitive drum is inserted from above the image forming apparatus body as described above, the unit has been conventionally fixed (positioned) by using the following structure.

The apparatus body includes a pair of side plates by which the unit is supported. Each of the paired side plates has a cut portion extending in the up-down direction. Further, the apparatus body includes a driving motor, and an apparatus-body-side gear which is driven to rotate by the driving motor. On the other hand, a large-diameter gear that reduces a rotation rate of the driving motor to a predetermined rotation rate for the photosensitive drum is mounted to a rotation shaft of the photosensitive drum. The rotation shaft of the photosensitive drum is fitted into the cut portions formed on the pair of side plates, thereby mounting the drum unit to the apparatus body. At this time, the apparatus-body-side gear and the large-diameter gear mesh with each other, and a rotation rate of the driving motor is reduced at a predetermined reduction ratio by the large-diameter gear, thereby transmitting the rotational power of the driving motor to the photosensitive drum.

The unit is a consumable product and needs to be periodically exchanged. However, the gear is a member that exerts a significant influence on image quality, needs to be manufactured with high accuracy, and is expensive. Since such an expensive large-diameter gear is mounted to the unit that is periodically exchanged, maintenance cost for the image forming apparatus has been heavy.

On the other hand, in the present embodiment, the large-diameter gear 403, which is expensive, is mounted to the driving-side unit 400 installed in the apparatus body instead of the cleaning unit 100 that needs to be exchanged. Therefore, the large-diameter gear 403 need not be exchanged each time the photosensitive drum 13 or the like reaches the end of its life, thereby enabling reduction in maintenance cost for the image forming apparatus 1.

In a case where a position at which the photosensitive drum 13 is to be mounted, deviates from a position represented by a designed value, an image forming position on the intermediate transfer belt 7A deviates from a proper position. In the tandem-type image forming apparatus as described in the present embodiment, a so-called color shift occurs due to deviation of each of the image forming positions in the image forming portions 3 to 6. Therefore, the photosensitive drums 13 to 16 need to be mounted at precise positions with high accuracy.

Figure 14A:
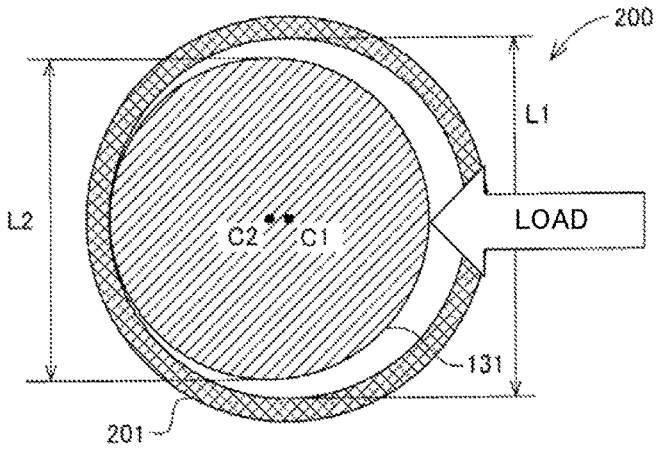
FIG. 14A, FIG. 14B, and FIG. 14C illustrate displacement of a flange of the photosensitive drum in the case of an inner diameter of a fitting portion of the bearing being set so as to be greater than a diameter of the flange of the photosensitive drum.

On the other hand, in the present embodiment, as described above, the photosensitive drum 13 rotates in a state where the flange 131 is fitted into the fitting portion 201 of the bearing 200 supported by the side plate 300. In consideration of a diameter being increased due to thermal expansion of the flange 131, an inner diameter L1 of the fitting portion 201 of the bearing 200 is set so as to be greater than a diameter L2 of the flange 131 by a predetermined length, as shown in FIG. 14A. Therefore, the flange 131 of the photosensitive drum 13 can be displaced in the fitting portion 201 within a clearance between the fitting portion 201 and the flange 131.

Figure 14B:
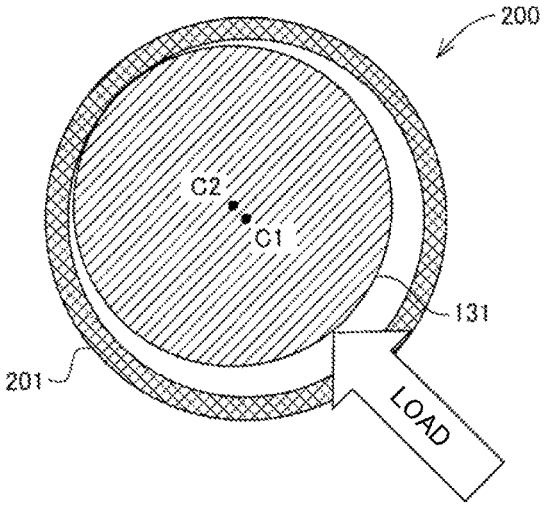
Figure 14C:
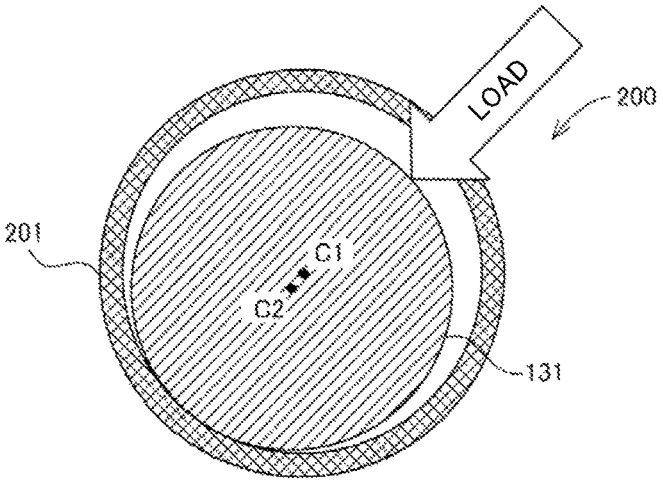
Figure 15A:
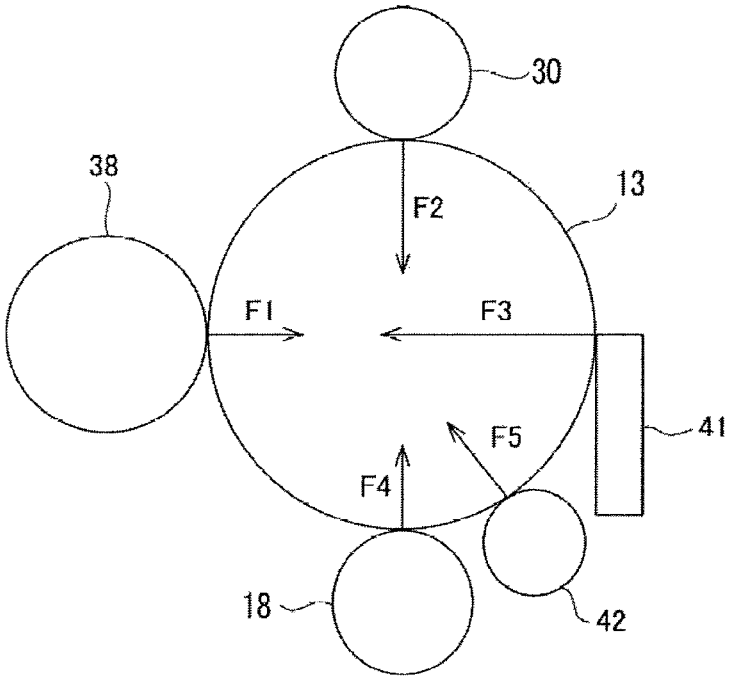
FIG. 15A and FIG. 15B illustrate a load applied from a peripheral device to the photosensitive drum.

In the present embodiment, as shown in FIG. 15A, loads F1 to F5 are applied to the photosensitive drum 13 from the charging roller 18, the primary transfer roller 30, the magnet roller 38, the cleaning roller 42, and the cleaning blade 41. Therefore, as shown in FIG. 14A to FIG. 14C, the flange 131 of the photosensitive drum 13 is displaced in the fitting portion 201 according to a direction and a magnitude of a composite load obtained by combining the loads F1 to F5. Namely, the photosensitive drum 13 is displaced. In FIG. 14A to FIG. 14C, a point C1 represents the center of the cross-section of the flange 131 of the photosensitive drum 13, and a point C2 represents the center of the cross-section of the fitting portion 201. Such a displacement of the photosensitive drum 13 causes reduction of image quality as described above.

Figure 16:
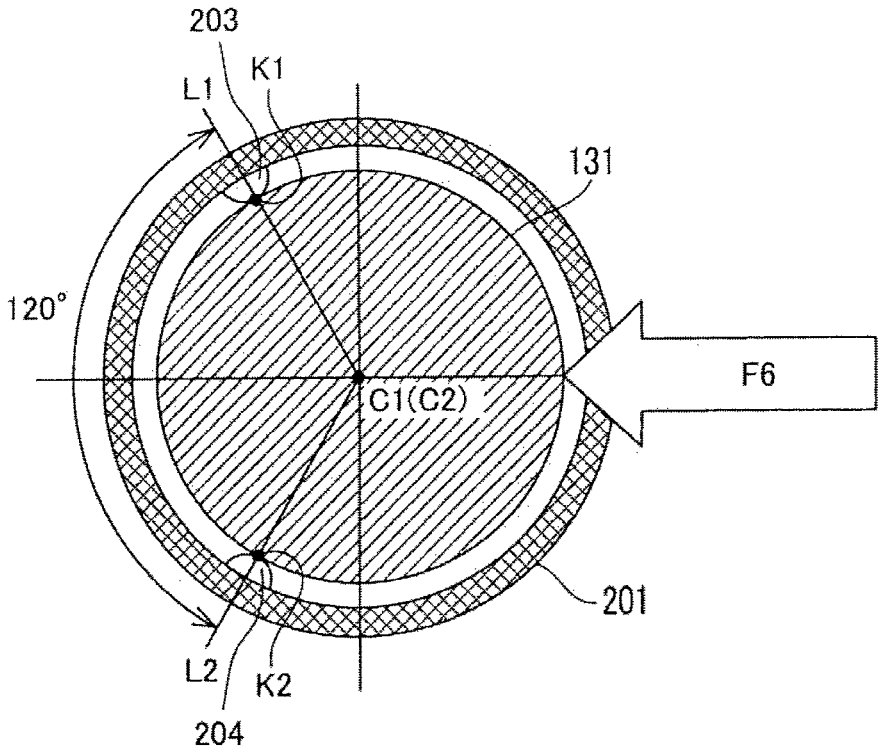
FIG. 16 illustrates positions of portions, on an inner circumferential surface of the bearing, which contact with the flange of the photosensitive drum.

In the present embodiment, the flange 131 is fixed in the fitting portion 201 of the bearing 200 by using the following structure. FIG. 16 conceptually illustrates a state where the flange 131 is fixed in the fitting portion 201 of the bearing 200.

Figure 15B:
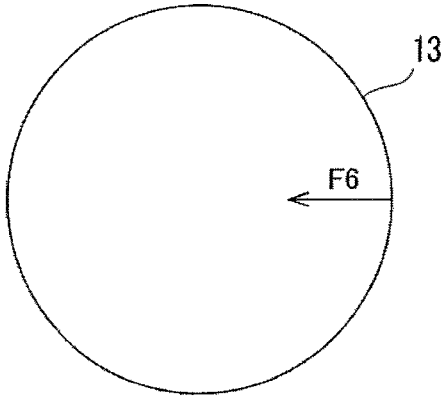

As shown in FIG. 15B and FIG. 16, a composite load obtained by combining the loads F1 to F5 is represented as a load F6. At this time, the inner circumferential surface of the fitting portion 201 of the bearing 200 and the flange 131 contact with each other at a support point K1 and a support point K2 that are two points which are line-symmetric with respect to the direction of the load F6. More specifically, as described above, the bearing 200 includes the plane portion W1 and the plane portion W2 that are planar on the inner circumferential surface, and the plane portion W1 and the plane portion W2 act as the support point K1 and the support point K2. Thus, since the flange 131 is supported at the plane portion W1 and the plane portion W2, the support point K1 and the support point K2 are less likely to be worn. In the example shown in FIG. 16, the support point K1 and the support point K2 are conceptually represented as a projection 203 and a projection 204. Instead of the plane portion W1 and the plane portion W2, the projection 203 and the projection 204 may be provided as the support point K1 and the support point K2, in another embodiment.

Further, the support point K1 and the support point K2 are disposed so as to be distant from each other by an angular distance of 120 degrees as from the center C1 of the cross-section of the flange 131 of the photosensitive drum 13. Thus, the flange 131 is stably held by the support point K1 and the support point K2. Needless to say, a distance between the support point K1 and the support point K2 in the present disclosure is not limited to 120 degrees.

In the image forming apparatus 1 having such a structure, the flange 131 of the photosensitive drum 13 is pressed, due to the composite load F6, against the inner circumferential surface 205 of the bearing 200 at the support point K1 and the support point K2, and supported by the two points. Therefore, the position of the photosensitive drum 13 is fixed, to position the photosensitive drum 13.

As described above, the drum supporting structure 600 of the image forming apparatus 1 according to the present embodiment is a structure where the flange 131 of the photosensitive drum 13 connected to the shaft joint member 404 that is connected to the drive shaft through which drive power of the driving motor is transmitted, is rotatably supported by the bearing 200 with which the photosensitive drum 13 contacts at the two points K1, K2 due to a load applied from the peripheral device such as the cleaning roller 42.

A preferred embodiment of the present disclosure has been described above. However, the present disclosure is not limited to the contents described above. Various modifications can be made.

In the case of an image forming apparatus that does not include the cleaning roller 42, a position at which the flange 131 of the photosensitive drum 13 and the inner circumferential surface 205 of the bearing 200 contact with each other may be determined based on a composite load obtained by combining loads from the members, other than the cleaning roller 42, which are described in the above embodiment.

For example, when a diameter of a cross-section of the flange 131 of the photosensitive drum 13 is changed, positions of the plane portions W1, W2 to be formed on the inner circumferential surface 205 of the bearing 200 are changed. Thus, in a case where different types of the photosensitive drums 13 are mounted to the cleaning unit 100, for example, in a case where the diameters of the cross-sections of the flanges 131 of the photosensitive drums 13 are various, the bearing 200 may be produced according to the type of the photosensitive drum 13. In a case where the bearing 200 is produced according to the type of the photosensitive drum 13, the cleaning unit 100 may be structured such that the bearing 200 can be mounted to the cleaning unit 100. Further, instead of the plane portions W1, W2, a curved surface portion having a surface shape different from that of the inner circumferential surface 205 may be used.

It is to be understood that the embodiments herein are illustrative and not restrictive, since the scope of the disclosure is defined by the appended claims rather than by the description preceding them, and all changes that fall within metes and bounds of the claims, or equivalence of such metes and bounds thereof are therefore intended to be embraced by the claims.

The invention claimed is:

1. A drum supporting structure adapted to a cleaning device formed as a unit including a photosensitive drum and a cleaning portion both mounted to a housing, the drum supporting structure rotatably supporting the photosensitive drum, which is connected to a shaft joint member that is connected to a drive shaft through which drive power is transmitted, the cleaning portion being configured to contact a surface of the photosensitive drum and remove residual toner on the surface of the photosensitive drum, the drum supporting structure comprising:

a cylindrical flange disposed on the photosensitive drum and configured to be fitted into and connected to the shaft joint member; and a bearing disposed in the housing and configured to rotatably support the flange, the bearing including an inner circumferential surface fitted on the flange in a state where there is a gap between the inner circumferential surface and an outer circumferential surface of the flange, the inner circumferential surface including two planes, a long arc surface and a short arc surface, the two planes being separate from each other in a circumferential direction of the inner circumferential surface, the long arc surface and the short arc surface each connecting the two planes in the circumferential direction, the long arc surface being longer than the short arc surface in the circumferential direction, the bearing supporting the flange in a state where the outer circumferential surface of the flange is contacted with the two planes by a two-point contact due to a composite load which is a combination of a plurality of loads from a plurality of directions applied from the cleaning portion and a peripheral device to the photosensitive drum, such that the flange is rotatable, the two planes, sandwiching the short arc surface, being line-symmetric with respect to a direction in which the composite load is applied.

2. The drum supporting structure according to claim 1, wherein the two planes are disposed so as to be distant from each other by an angular distance of 120 degrees as from a center of the bearing.

3. The drum supporting structure according to claim 1, wherein the peripheral device includes at least one of a charging device that charges a surface of the photosensitive drum, a developing device that develops an electrostatic latent image formed on the surface of the photosensitive drum, and a transfer device that transfers a developed image formed on the surface of the photosensitive drum by the developing device, to an object to which the image is to be transferred.

4. The drum supporting structure according to claim 1, wherein, to the cleaning device, different types of the bearings are mountable.

5. The drum supporting structure according to claim 1, further comprising a bearing support portion, disposed in a frame of an image forming apparatus having the drum supporting structure, configured to support an outer arc circumferential surface of the bearing at two points that are line-symmetric with respect to a vertical line.

6. An image forming apparatus having the drum supporting structure according to claim 1.

7. The image forming apparatus according to claim 6, further comprising:

the photosensitive drum;

a driving-side unit including a large-diameter gear that reduces a rotation rate of a driving motor to a predetermined rotation rate for the photosensitive drum, and a shaft joint member that connects between a drive shaft of the large-diameter gear and the flange of the photosensitive drum, the bearing being configured to support, through the flange, the photosensitive drum connected to the drive shaft of the large-diameter gear by the bearing being fitted on the outer surface of the photosensitive drum, such that the photosensitive drum is rotatable; and a body frame configured to support the bearing.

8. A bearing adapted to a cleaning device formed as a unit including a photosensitive drum and a cleaning portion both mounted to a housing, and a drum supporting structure, the drum supporting structure rotatably supporting the photosensitive drum, which is connected to a shaft joint member that is connected to a drive shaft through which drive power is transmitted, the drum supporting structure including a cylindrical flange disposed on the photosensitive drum and configured to be fitted into and connected to the shaft joint member, the cleaning portion being configured to contact a surface of the photosensitive drum and remove residual toner on the surface of the photosensitive drum, the bearing being disposed in the housing and configured to rotatably support the flange, the bearing comprising:

an inner circumferential surface fitted on the flange in a state where there is a gap between the inner circumferential surface and an outer circumferential surface of the flange, the inner circumferential surface including two planes, a long arc surface and a short arc surface, the two planes being separate from each other in a circumferential direction of the inner circumferential surface, the long arc surface and the short arc surface each connecting the two planes in the circumferential direction, the long arc surface being longer than the short arc surface in the circumferential direction, the bearing supporting the flange in a state where the outer circumferential surface of the flange is contacted with the two planes by a two-point contact due to a composite load which is a combination of a plurality of loads from a plurality of directions applied from the cleaning portion and a peripheral device to the photosensitive drum, such that the flange is rotatable, the two planes, sandwiching the short arc surface, being line-symmetric with respect to a direction in which the composite load is applied.

* * * * *